United States Patent [19]

Rock et al.

[11] Patent Number: 4,558,638

[45] Date of Patent: Dec. 17, 1985

[54] VENTILATING PROFILE FRAMES FOR CLOSURE PANELS

[75] Inventors: Siegfried Rock; Hans-Peter Rainer; Reinhold Herzog, all of Graz; Werner Wertitsch; Günter Kromus, both of Vienna; Fritz Kölbl, Niklasdork, all of Austria

[73] Assignee: Contacting-Gesellschaft fur Wirlshaftskontakte GmbH, Vienna, Austria

[21] Appl. No.: 467,484

[22] PCT Filed: Jun. 16, 1982

[86] PCT No.: PCT/AT82/00019

§ 371 Date: Feb. 15, 1983

§ 102(e) Date: Feb. 15, 1983

[87] PCT Pub. No.: WO82/04460

PCT Pub. Date: Dec. 23, 1982

[30] Foreign Application Priority Data

Jun. 17, 1981 [AT] Austria ..... 2704/81

[51] Int. Cl.[4] ..... E06B 7/02

[52] U.S. Cl. ..... 98/88.1; 98/DIG. 10

[58] Field of Search ..... 49/45, 483; 98/87, 88 R, 98/97, 98, 99 R, 99.6, DIG. 10

[56] References Cited

U.S. PATENT DOCUMENTS

| | | | |
|---|---|---|---|
| 1,393,556 | 10/1921 | Lynn | 98/97 |
| 4,050,364 | 9/1977 | Maus | 98/88 R X |
| 4,328,650 | 5/1982 | Garbell | 98/88 R X |
| 4,425,739 | 1/1984 | Garbell | 98/88 R X |

FOREIGN PATENT DOCUMENTS

| | | | |
|---|---|---|---|
| 127309 | 4/1948 | Australia | 98/88 R |
| 358794 | 9/1980 | Austria . | |
| 1116375 | 11/1961 | Fed. Rep. of Germany . | |
| 2042085 | 3/1972 | Fed. Rep. of Germany . | |
| 2361994 | 6/1975 | Fed. Rep. of Germany | 98/99 R |
| 2825303 | 12/1979 | Fed. Rep. of Germany . | |
| 497268 | 12/1919 | France . | |
| 1313976 | 11/1962 | France . | |
| 1342662 | 9/1963 | France . | |
| 2384093 | 10/1978 | France . | |
| 122773 | 10/1927 | Switzerland | 98/88 R |
| 402367 | 5/1966 | Switzerland . | |
| 1117373 | 6/1968 | United Kingdom . | |
| 1132595 | 11/1968 | United Kingdom . | |
| 1470841 | 4/1977 | United Kingdom . | |

*Primary Examiner*—Harold Joyce

*Attorney, Agent, or Firm*—Ladas & Parry

[57] ABSTRACT

A closure panel assembly, such as windows, doors, a partition wall and the like, comprising a planar member secured in a profiled frame which is mounted for movement with respect to a complementary profiled fixed frame, such as a casing, against which it sealingly bears, in a closed position, to an aeration position being produced by exposing the profiled frame from the sealing position. There is provided in the aeration position an aeration gap between the profiled frame and the profiled fixed frame, on the side area of which there is disposed a flexibly sealing and/or noise-damping and/or fireproof material. The aeration gap between both frames in cross section has a serpentine path, wherein at least in the narrowest aeration position in the area between a first section open toward one side of the frames and orientated in the direction of movement of the profiled frame, and a third section open toward the other side of the frames and orientated in the same direction, and at least one intermediate section orientated oppositely to said direction of frame movement.

13 Claims, 5 Drawing Figures

VENTILATING PROFILE FRAMES FOR CLOSURE PANELS

BACKGROUND OF THE INVENTION

The invention relates to a closure panel assembly, such as a window, a door, a partition wall, and the like, comprising a planar member secured in a profiled frame which is mounted for movement with respect to a complementary profiled fixed frame, between a closed sealed position and an aeration open position.

A closure panel is known in the form of a swinging casement window, wherein a separation slit between the circular contour of the profiled frame of the casement window and the casing surrounding said casement window defines a Z-shaped in cross section aeration gap between the profiled frame of the casement window and the casing. In order to obtain now satisfactory aeration through the gap surrounding the casement window and at the same time marked attenuation of the noise passing through the Z-shaped gap, it is necessary to secure relatively precise adjustment of the position of the casement window in respect of the casing. Such adjustment requires fittings functioning with precision and careful attendance, the first requirement increasing the cost of production and careful attendance as a rule is not provided.

Also other already proposed solutions for attaining aeration which as much as possible also prevent the nuisance of the passage of noise, such as, for example, the insertion of noise damping vents, require from the overall point of view a relatively considerable expense and as a rule also require much space, so that in many cases such solutions cannot be recognized where space is scarce.

Apart from the question of noise damping, the problem of the passage of dust in gap aerations must be given consideration, and also in this respect a relative precise adjustment must be provided in a Z-shaped aeration gap in an effort to prevent the passage of dust through the aeration gap.

SUMMARY OF THE INVENTION

It is an object of the present invention to provide a closure panel assembly of the kind described at the outset, which secures satisfactory, preferably adjustable, gap aeration, and at the same time satisfactory noise inhibition and extensive inhibition of the passage of dust and possibly satisfactory damping against the passage of flames in the case of fire; these characteristics must be provided without the requirement of particularly narrow tolerances in machining and without the requirement of particularly precise adjustment in use.

For such purpose the invention provides a closure panel assembly, such as window, door, wall, comprising a planar member secured in a profiled frame which is mounted movable with respect to a profiled fixed frame, such as a casing, against which it sealingly bears, in a closed position, to an aeration position being produced by opening the profiled frame from the sealing position, wherein there is an aeration gap between the profiled frame and the profiled fixed frame during a change in direction, a flexibly-sealing and/or noise damping and/or fireproof material being disposed on the side area of the aeration gap, the aeration gap between both frames in cross section having a serpentine pass, wherein at least in the narrowest aeration position in the range between one section open toward both frames and orientated in the exposed direction and one section open to the other side of both frames and orientated in the exposed direction there is at least one section orientated in the direction opposite to that of the exposed direction. The construction of the invention, due to the special course of the aeration gap, permits certain variation in the position of the profiled frame with respect to the profiled fixed frame surrounding the profiled frame without substantially changing the characteristics of noise damping and dust inhibiting, and due to the provided course of the aeration gap which produces very satisfactory noise damping, there can also be provided a relatively large gap cross section, which permits liberal passage of air for the intended aeration. The provided course of the aeration gap considerably inhibits the passage of dust. Since the main sections of aeration gap extend in the opening direction of the profiled frame and opposite to said direction, the profiled frame can be checked in a certain range without appreciably changing the cross section of the aeration gap in the said gap sections extending in the exposed direction or opposite thereto.

In an embodiment of the closure panel assembly the profiled frame is pivotable around a vertical axis in addition to the profiled frame being infinitely adjustable and adapted to be checked in selected positions.

Support for parallel movement of the profiled frame permits all around the assembly a uniform aeration gap. For such support of the profiled frame it is expedient to introduce special functional fittings which can also be so conceived that, subsequent to parallel movement, brings the profiled frame in respect of the profiled fixed frame from the sealing to the aeration position, there is possible an associated swivelling of the profiled frame around the vertical axis.

Another expedient embodiment is characterized in that the profiled frame and the profiled fixed frame viewed in cross section may be of approximately L-shaped configuration and with a sealing strip of an approximately L- or U- or E-shape in cross section, said strip having a projecting shoulder which embodies the side boundary of an approximately U-shaped groove provided by the frame and the sealing strip. The result is a particularly satisfactory sealing in the sealing position provided that precaution is taken that in the sealing position the side groove edge of one frame bears against the bottom of the groove of the other frame. There is so achieved an inner multiple sealing. Furthermore, it is advantageous both from the point of view of the configuration of the resulting aeration gap and of the simplification of production if both frames are of the same profiled cross section in the area of the aeration gap and are facing each other.

The noise damping can be adjusted to requirements of each case, particularly in certain categories of noise prevention by the corresponding shaping of the frame profiles.

To meet the various requirements in respect of the lining of the profiles, it may be expedient if the flexibly sealing or noise-damping or fireproof material consists of at least two adjacent parts, which join each othher in the direction of the course of the gap and are different as to their flexibility. It is expedient in this connection if the flexibly sealing material in each portion, which engages the groove of the opposite frame, is more rigid than in the other portion.

It is also advantageous if the flexibly sealing or noise-damping or fireproof material is a multilayer, particularly two-layer material. It is expedient in this connection if the flexibly sealing or noise-damping or fireproof material has layers of different thickness and tightness and a structural surface skin. The various requirements of noise damping, satisfactory sealing in the sealing position, and rigidity of the frame profiles can be achieved by a multilayer construction of the flexibly sealing, noise-damping or fireproof material.

Further, it is particularly advantageous for noise damping, but also for the stability and for the assembly of the lining if the material having flexibly sealing or noise-damping properties on its side facing the aeration gap has a surface fissured by longitudinal strips which break the sound or pyramid shaped projections.

In view of the special configuration of the aeration gap in the closure panel of the invention, a special embodiment of the frame is advantageous when the elevation parts of the frame can be divided by simple cross-cuts and no miter joints are necessary and where the fittings and the functional parts do not have to be mounted on the elevation parts. This embodiment of the closure panel is characterized in that in simple assembly the frames of elevation parts, corner joints, which have elevations on both sides of the geometric corners, fitting supports and a functional part support, are assembled together. It is advantageous in this connection to provide in the frame profile passages, into which at places of juncture can be inserted juncture bolts or connection strips. Also in the profiles of the frames can be provided passages, in which can be conducted tension wires to tighten the frames and thus compactly and forcibly join the frames of the closure panel.

Also frame parts can be produced to then be combined with each other to form larger units.

As a precaution against pouring rain and penetrating dust, it is expedient to provide in the winding aeration gap area a sealing and filter lip which traps dust. It is also expedient to provide in the sealing lip a heating conduit, which can heat air flowing through the aeration gap.

Between the profiled fixed frame and the wall can be provided a hollow member for connecting the profiled fixed frame and an adjacent main wall, said member being filled with damping support foam. This achieves the best tightness in the connection of parts which can be constructed on a time-saving basis. The hollow member can be positioned by an articulated compensation part inserted between the profiled fixed frame and the wall, or it can be fixed by suitable strips which hold the hollow member and engage slots or channels of the profiled fixed frame.

The closure panel of the invention, which can be provided, for example, as a window, a door, but also as a wall or on facades, has, as above indicated, a number of advantageous characteristics, among which should be particularly stressed the satisfactory noise damping in the aeration position, satisfactory heat damping, and ease of production. It should also be pointed out that because both cooperating frames are provided in cross section with approximately U-shaped grooves and are assembled by the engagement of these each other cooperating facing grooves, in the sealing position high quality multiple seals are provided which protect against other influences. An important advantage is also the possibility to change the aeration gaps to adjust aeration.

Where multiple frames are assembled, corner joints, supports for fittings, or other functional parts, can also be readily assembled at the site so that the transport to the site of installation is easier because the premanufactured members and components need less space in transport than completely assembled profiled frames.

The invention also provides unique frame profiles for the closure panel assembly of the invention. Such frame profile is characterized in that the profile has an approximately U-shaped groove on a longitudinal side, and a lining having flexibly sealing or noise-damping or fireproof properties. Another frame profile of the invention is characterized in that the profile has in cross section an approximately L-shaped configuration and a sealing strip lining of an approximately L- or U- or E-shaped cross section is inserted in said profile, said strip being a freely projecting leg which constitutes a side boundary wall of an approximately U-shaped groove formed by the profile and the sealing strip. A number of advantageous further developments of this frame profile is possible.

BRIEF DESCRIPTION OF THE DRAWINGS

The invention will now be described with reference to embodiments diagrammatically illustrated in the drawing.

DESCRIPTION OF THE PREFERRED EMBODIMENTS

Figure 1:
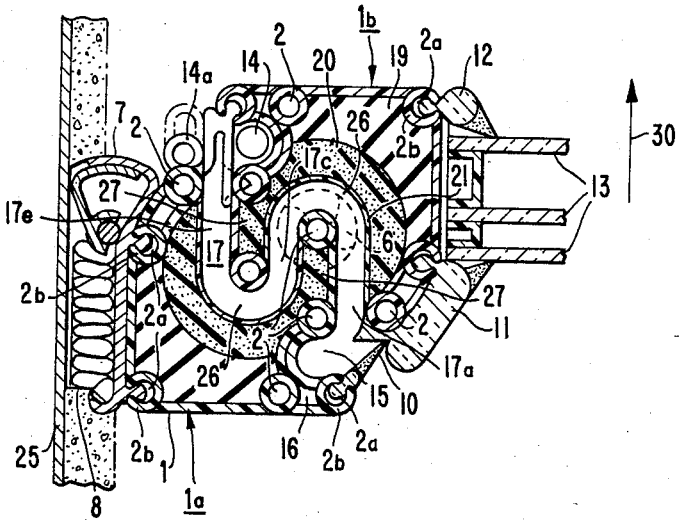
FIG. 1 shows the frame area of an embodiment of the panel closure assembly of the invention connected to a structural part, in horizontal cross section.
Figure 2:
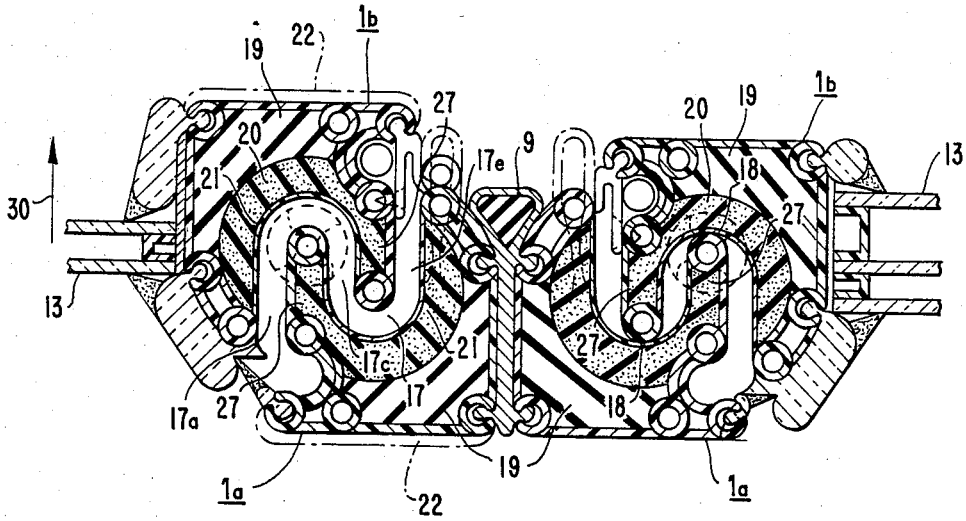
FIG. 2 likewise in horizontal cross section shows the frame area of two combined-together closure panels, one at right being shown in the closed and the other in the aeration condition.
Figure 3:
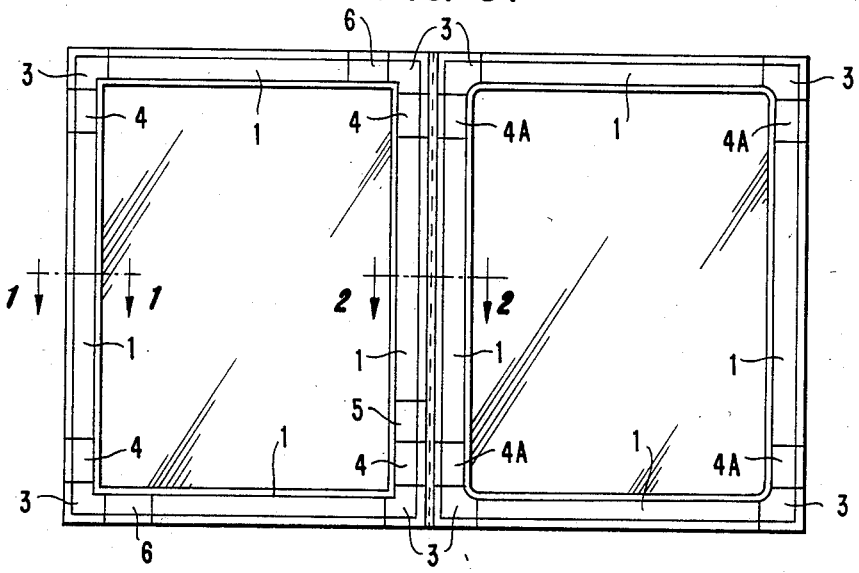
FIG. 3 is a view of two combined closure panels.

In the embodiment shown in FIG. 1, the profiled fixed frame 1*a* and the profiled frame 1*b* of the closure panel have complementary profiles 1. Said profile 1 is provided with a number of longitudinal channels 2, which make the frame connected with said profile more rigid and make possible that the profiled parts are held together with corner members 3, fitting and closure members 4, special fittings 4*a*, functional parts 5, and aeration and ventilation members which may be provided with fan 6. Also in profile 1 are provided longitudinal passageways 2*a*, which are open to the outside via slots 2*b*. Such open passageways 2*a* in the profile of the fixed frame (1*a*) make it possible to connect the frame into the structural main wall 25 an articulated connection part 7 with a hollow member 8 filled with damping and reinforcing material, preferably damping support foam. Such longitudinal open passageways 2*a* are used in the profile 1 of the profile frame 1*b* for fixing glass strips 11, 12 which are inserted or slid on the profile and hold glass plates 13. By changing the glass strips 11, 12, it is possible to insert glass plates 13 of different thicknesses. Another longitudinal, open channel of the profile of the fixed frame 1*a* holds a sealing and filter lip 10. The profile 1 is also provided with an open channel of a larger cross section, which is identified by reference numeral 14 in the profiled frame 1*b* and by 15 in the fixed frame 1*a*. Channel 14 receives a guide fitting 14*a* adjustably connecting profiled frame 1*b* to fixed frame 1a. Passageway 15 which is located in the fixed frame performs the function of a water-draining trough, from which go out draining slots 16. Profiles 1 of the fixed frame 1a and of the profiled frame 1b are lined with flexibly sealing and, noise-damping material. The shaping is so selected that the profiles 1 each have a groove 26 approximately U-shaped in cross section, and the open side of these grooves of both frames 1a, 1b are facing each other. A lateral boundary wall 27 provided on one side of each of these grooves engages the opposite groove of the profile 1 when both frames are disposed one next to the other, as shown in FIGS. 1 and 2. The front edges of the lateral boundary walls of the grooves 26 then lie in the sealing position of the closure panel, as shown at the right of FIG. 2, in the bottom of the corresponding grooves 26 of the other profile, resulting in such way in an inner double sealing 18, well protected against outside influences and providing very satisfactory sealing. If the profiled frame 1b is moved from the sealing position, shown at the right of FIG. 2, in respect of the fixed frame 1a in the direction indicated by arrows 30, then the closure panel frames reach the aeration position shown in FIG. 1 and in FIG. 2 at the left. In the position of aeration, between frames 1a and 1b there is an aeration gap 17 which has a winding serpentine path. The aeration gap 17 in a first section 17a is open toward one side of both frames 1a, 1b and orientated in the opening direction 30, a second section 17c is orientated opposite to said direction 30, and a third section 17e of the aeration gap opened to the other side of both frames 1a, 1b is orientated in the same opening direction 30. The lining of profiles 1 is a multilayer lining. A first layer 19 which is of damping material of high specific density and which at the same time imparts rigidity to profiles 1 is followed by a layer 20 of damping material of lower specific density, which has a special surface skin 21 and provides a satisfactory air sound, fire and heat damping. This damping is particularly effective thanks to the multiple breaks or reversals in the direction of the aeration gap 17, and the profiled frame 1b can be selectively moved away from the fixed frame 1a, without changing the basic configuration of the aeration gap 17. The air permeability of the aeration gap can be varied by more or less movements of frame 1b. For this purpose, there is preferably provided a stepless adjustability relative to each other of frames 1a, 1b enclosing the aeration gap 17 and a possibility of checking each selected position of said frames. For this purpose can be provided, for example, a bolt (not shown) with an inclined area, which if so desired can be adjustable by shifting. A profile configuration corresponding to profile 1 is also applied to the corner members 3, fittings and locking members 4, functional members 5, and ventilation members 6. As shown in FIGS. 2 and 3, the frame profiles in the closure panels of the invention can also be combined with connection members 9 to form larger units. In the case illustrated, the connecting member 9 engages opposite open channels 2a of adjacent fixed frames 1a to be thereby fixed in said profiles. The surface of the closure panel assembly of the invention can, if desired, be provided with special inserted parts 22, shown at the left of FIG. 2. Such inserted parts can be applied by using open channels 2a of each profile 1. Such surface modifications are particularly advantageous when the profiles 1 are of a material such as, for example, PVC, to which varnishes and coatings do not adhere firmly enough or can be applied only by expensive processes.

Figure 4:
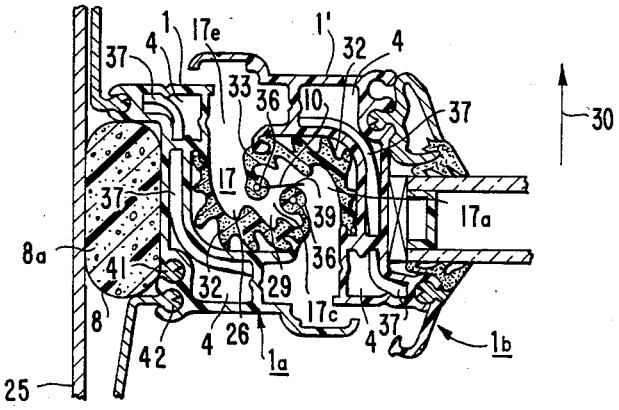
FIG. 4 is another embodiment of a closure panel in cross section.

In the embodiment of the closure panel of the invention shown in FIG. 4, the profiled fixed frame 1a and the profiled frame 1b are made of profiles 1 and 1', which in cross section have an approximately L-shaped configuration. A sealing strip 32 is inserted in each of these profiles 1, 1' as a flexibly sealing lining, such strips in cross section in the inserted position being approximately U-shaped and having a leg 33 freely projecting from each profile 1, 1'. This leg 33 embodies a side boundary wall of an approximately U-shaped groove 26 produced by each frame 1a, 1b and the sealing strip 32. The profiled frame 1b is openable in respect of the profiled fixed frame 1a. The movement of the profiled frame 1b in said opening direction, indicated by arrow 30, releases the closure panel from its sealed position, in which the leg 33 bears against the groove bottom 29 of the groove 26 of the other corresponding frame, into the narrow aeration position shown in FIG. 4; the continuation of the opening movement can increase the permeability of the aeration gap 17.

Profiles 1, 1' of both frames 1a, 1b in the aeration gap 17 area are of the same profile cross section and are facing each other.

The aeration gap 17 has a serpentine path defined by a first section 17a open toward one side of both frames 1a, 1b and orientated in the opening direction 30, third section 17e open toward the other side of both frames 1a, 1b and orientated in the same direction 30, and a second section 17c orientated oppositely to said direction. If desired, there can also be provided a plurality of such sections 17c, within which other intermediate gap sections orientated in said direction 30 are to be arranged; such arrangement provides very satisfactory noise damping and sealing against dust.

The side of the sealing strips 32 facing the aeration gap has a surface 29 fissured by longitudinal strips. This is advantageous for satisfactory noise damping and at the same time for the durability and resistance of the strip material.

The sealing strip 32 in the area of the edge 39 of its leg 33 has a slit 36 into which can be exchangeably inserted a sealing lip 10.

The frame profiles 1, 1' of frames 1a, 1b are provided with channels 40, into which can be inserted connection strips 37 at the places of assembly of the profiled parts.

A hollow member 8 is inserted between main walls 25 and the profiled fixed frame connected thereto, said member being filled with damping support foam. The hollow member 8 can be secured with strips 41, which engage open channels 42 of the fixed frame 1a.

Profiles 1, 1' expediently consist of fiber-reinforced hard plastic, such as, for example, glass-reinforced polyester, to provide good mechanical stability, low heat conductivity, easy machineability, and which lends itself to be well varnished and coated and provide resistance to the influence of climate; particularly, it does not expand and deform under the influence of heat. There can be considered also other reinforced fibers, such as carbon fibers.

Figure 5:
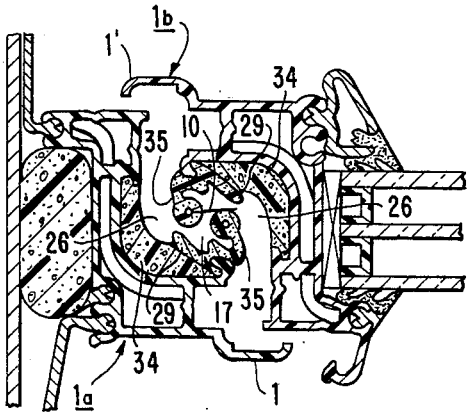
FIG. 5 is another variation.

In the variation of FIG. 5, the materials providing the lining of profiles 1, 1' are in the form of two parts which extend in the longitudinal direction one next to the other and are joined to each other in the direction of the aeration gap 17. Part 34 is softly flexible, porous, e.g. in the form of a foam with surface skin, and provides very good noise damping, while part 35 is more rigid but is still adequately flexible by a bending place to achieve good pressure of its edge on the bottom of groove 26 in the sealing position of the closure panel. Both parts 34, 35 preferably are glued or welded to each other.

We claim:

1. A closure panel assembly, such as a window, a door, a partition wall, and the like, comprising a planar member secured in a first, movable profiled frame and a second, stationary profiled frame, said first frame being mounted for movement with respect to said stationary frame, between a closed position in which said first frame is sealingly engaged with said second frame, and an open aeration position produced by translation movement of said first frame away from said second frame in a direction substantially perpendicular to the plane of said planar member, each of said frame members having a longitudinal extending U-shaped groove provided with a side boundary wall parallel to said direction of movement defining a leg of said U-shaped groove, said side boundary wall being adapted to engage correspondingly in the U-shaped groove of the opposite frame member, by said corresponding engaging of the side boundary wall of the U-shaped groove of the first frame in the U-shaped groove of the second frame and the side boundary wall of the U-shaped groove of the second frame in the U-shaped groove of the first frame and in said aeration position, a continuous serpentine aeration gap being provided between said first and second frames including a first gap portion extending from one said of said planar member in the direction of movement of said first frame, a second gap portion parallel to and extending in a direction opposite to said direction of movement of said first frame, a third gap portion parallel to said first and second portions and extending in the same direction of movement of said first frame to the opposite side of said planar member, said gap portions being interconnected by intermediate passage means to thereby define a continuous serpentine path between said first movable frame and said stationary second frame, and in said closed position, said frame members are in sealing engagement with each other and in said aeration gap between said first frame and second frame are provided noise damping means and sealing means on at least one of said frame members.

2. The assembly according to claim 1, wherein the first frame and second frame each include a rigid member having an approximately L-shaped configuration in cross-section, and a sealing strip in each frame member having a freely projecting shoulder, said rigid member together with said sealing strip forming the U-shaped groove of each frame member, said projecting shoulder of said sealing strip defining said side boundary wall of each U-shaped groove.

3. The assembly according to claim 1, wherein said side boundary wall of the U-shaped groove of one frame includes a portion which, in the closed sealing position, bears against the bottom of the corresponding U-shaped groove of the other frame.

4. The assembly according to claim 1, wherein said sealing means provided on at least one of said frame members comprises at least two sealing parts extending in the direction of the gap orientation and said parts have different flexibility characteristics.

5. The assembly according to claim 4, wherein each frame includes a flexible sealing strip having a relatively rigid part which engages the corresponding U-shaped groove of the other frame.

6. The assembly of claim 1, including noise-damping material arranged in the U-shaped groove in at least one of said frames.

7. The assembly of claim 1, including fire resistant material arranged in the U-shaped groove of at least one of said frames.

8. The assembly according to claim 1, wherein said sealing means comprises a flexible sealing, noise-damping multiple layer material.

9. The assembly according to claim 8, wherein the layers of said multiple layer material are of different thicknesses and consistency with a protective surface skin.

10. The assembly according to claim 8, wherein the flexible sealing, noise-damping, material has on its side facing the aeration gap a surface fissured by longitudinally extending strips.

11. The assembly according to claim 1, including a filter lip extending across a portion of the aeration gap, said lip being adapted to hold back dust.

12. The assembly according to claim 1, including a hollow member filled with damping support foam and inserted between an associated main wall and said stationary first frame which is secured to the main wall.

13. The assembly according to claim 12, wherein the hollow member is positioned with an expansion means introduced between the stationary first frame and the main wall.

* * * * *